United States Patent [19]

Turner et al.

[11] 4,316,563

[45] Feb. 23, 1982

[54] CONTAINER FOR DISPENSING ROLLED PRODUCT

[75] Inventors: Gerald W. Turner, Norristown, Pa.; Donald F. Wischoff, Fulton, N.Y.

[73] Assignee: Container Corporation of America, Chicago, Ill.

[21] Appl. No.: 179,053

[22] Filed: Aug. 18, 1980

[51] Int. Cl.[3] ..... B26F 3/02

[52] U.S. Cl. ..... 225/41; 225/49; 229/17 S

[58] Field of Search ..... 225/46–50, 225/41; 229/17 S; 206/389, 395, 396, 409, 415

[56] References Cited

U.S. PATENT DOCUMENTS

| | | | |
|---|---|---|---|
| 1,905,561 | 4/1933 | Gluck | 225/48 |
| 3,144,970 | 8/1964 | Beschmann | 225/48 X |
| 3,477,624 | 11/1969 | Branyon et al. | 225/47 X |
| 3,698,548 | 10/1972 | Stenzel et al. | 225/48 X |
| 4,238,065 | 12/1980 | Ragsdale | 229/17 S |
| 4,245,765 | 1/1981 | Gregg | 225/48 X |

*Primary Examiner*—Frank T. Yost

*Attorney, Agent, or Firm*—R. W. Carpenter; Davis Chin

[57] ABSTRACT

A container formed from a cut and scored blank of paperboard and adapted to support on opposed walls thereof a core in turn supporting a wound product which is dispensed from the container.

8 Claims, 8 Drawing Figures

CONTAINER FOR DISPENSING ROLLED PRODUCT

SUMMARY OF THE INVENTION

The invention structure is adapted to be formed from a cut and scored blank which can be folded and erected to support a core in turn supporting a wound product. In the invention herein the container is constructed so that a wall thereof operates as a cut-off for the product, and the cut and scored blank may be provided with a removable blank portion which is cut and scored to define a core for support of the wound product.

THE DRAWINGS

THE DESCRIPTION

Figure 1:
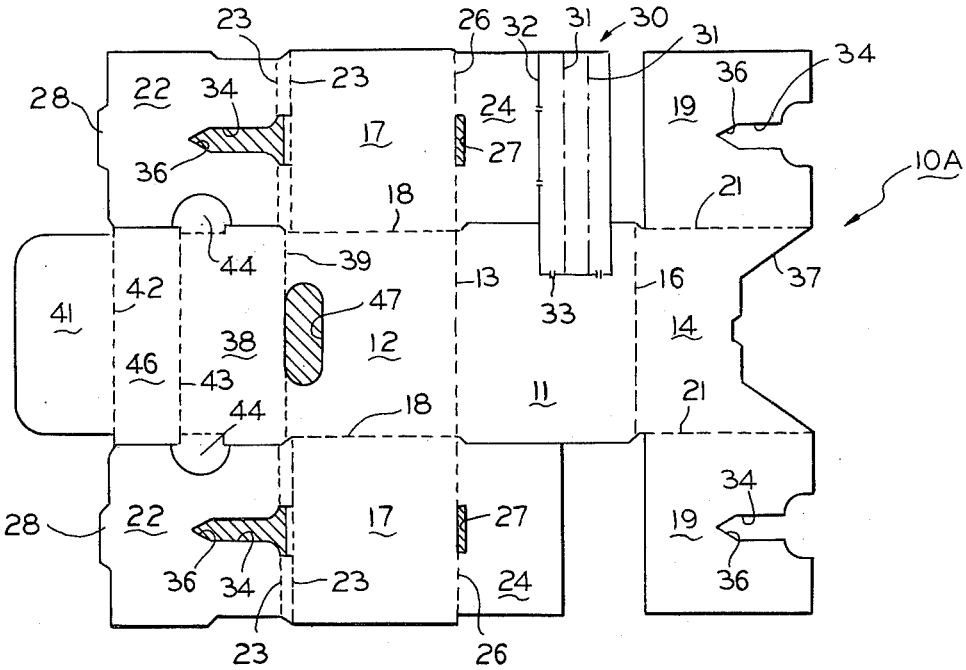
FIG. 1 is a plan view of a cut and scored blank for forming a container according to the present invention.
Figure 3:
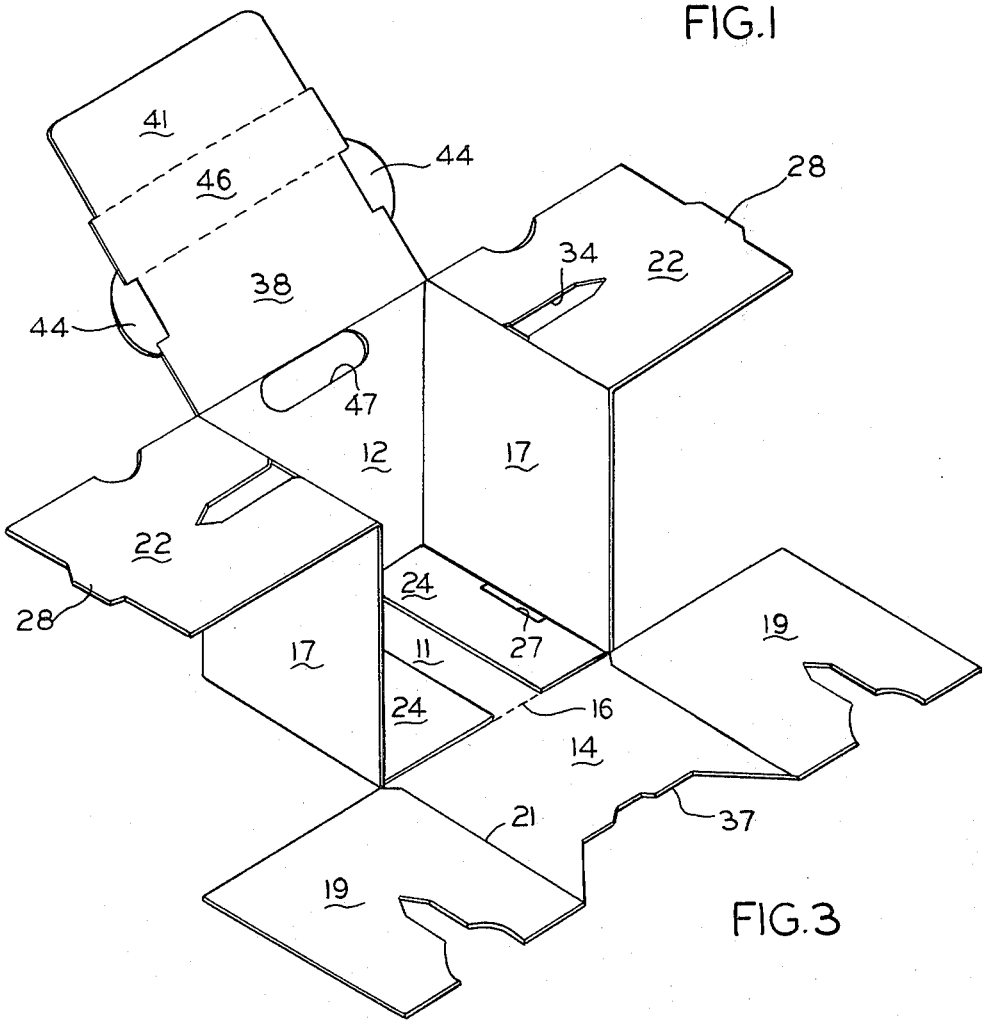
FIGS. 3, 4 and 5 are isometric views showing the steps in forming the container of FIG. 2.
Figure 4:
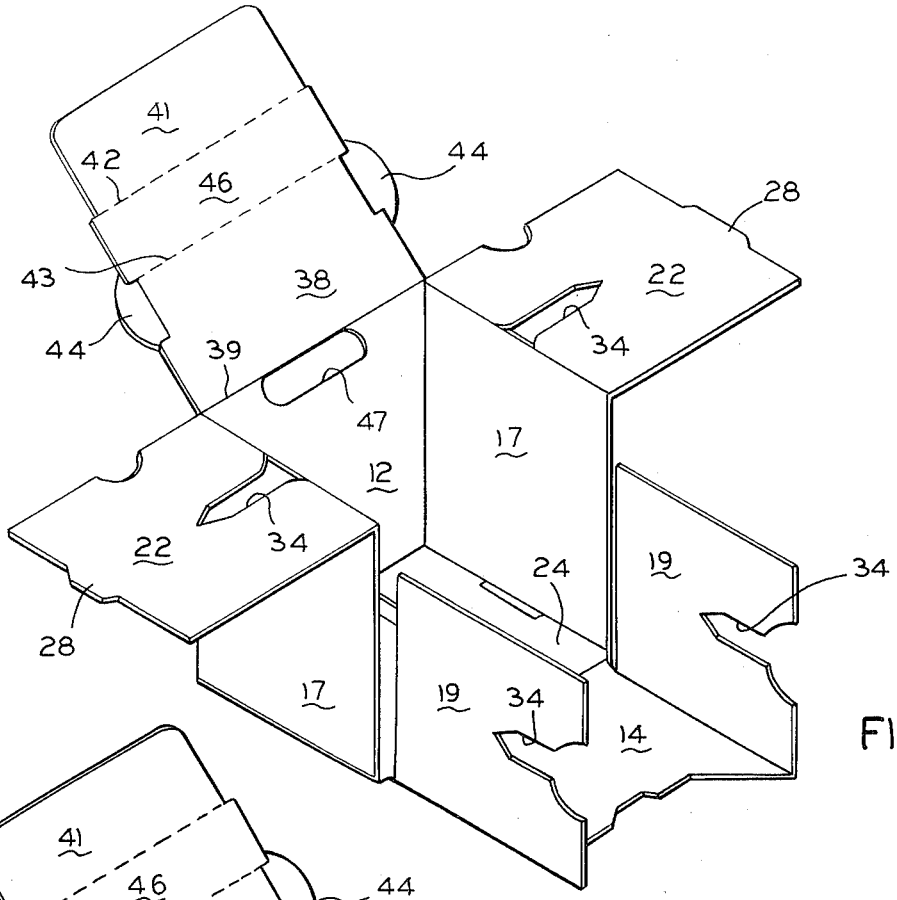
Figure 5:
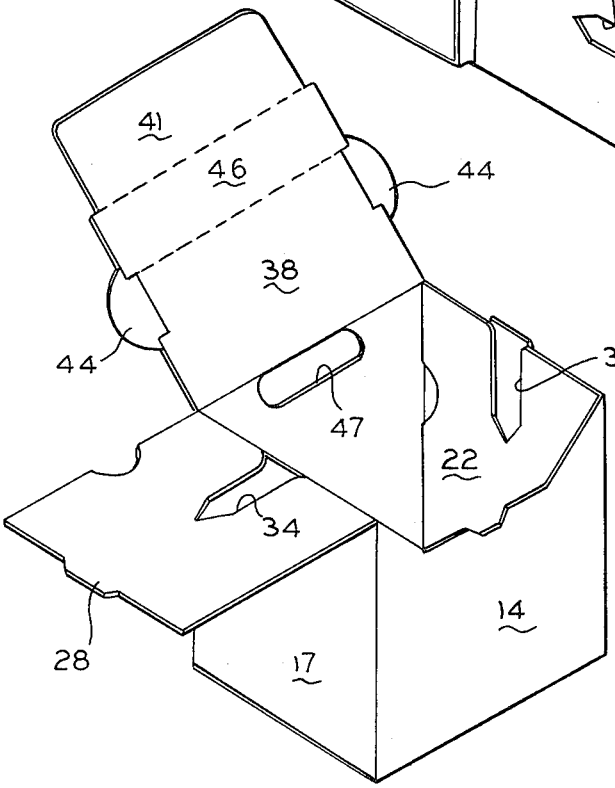
Figure 2:
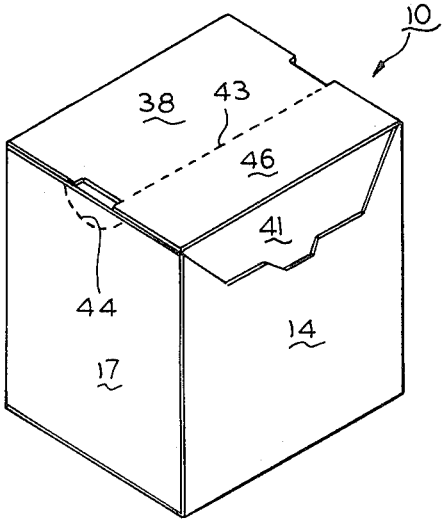
FIG. 2 is an isometric view showing the blank of FIG. 1 erected to form a container.
Figure 6:
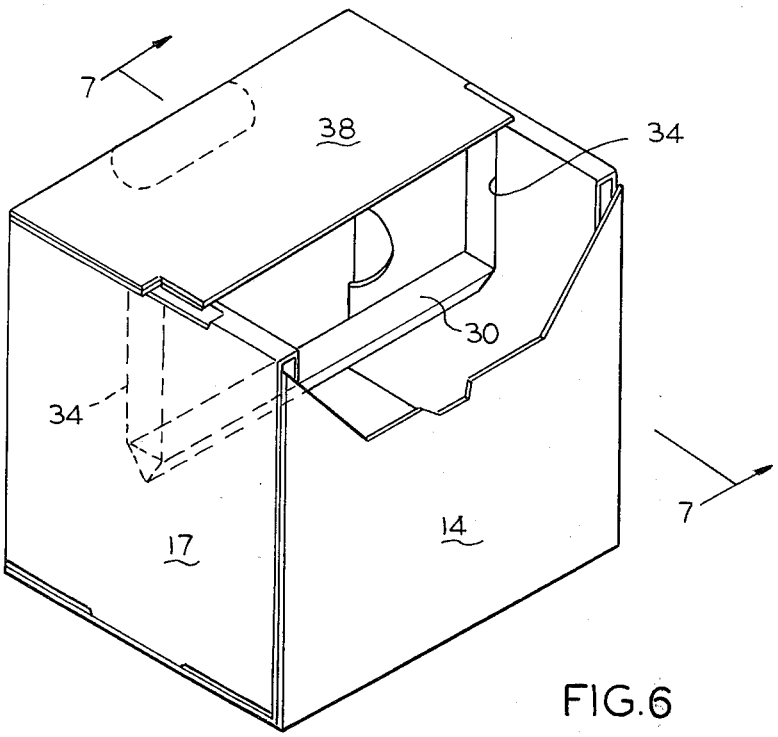
FIG. 6 is an isometric view showing part of the cover panel of FIG. 2 removed for dispensing of a product from the container.
Figure 7:
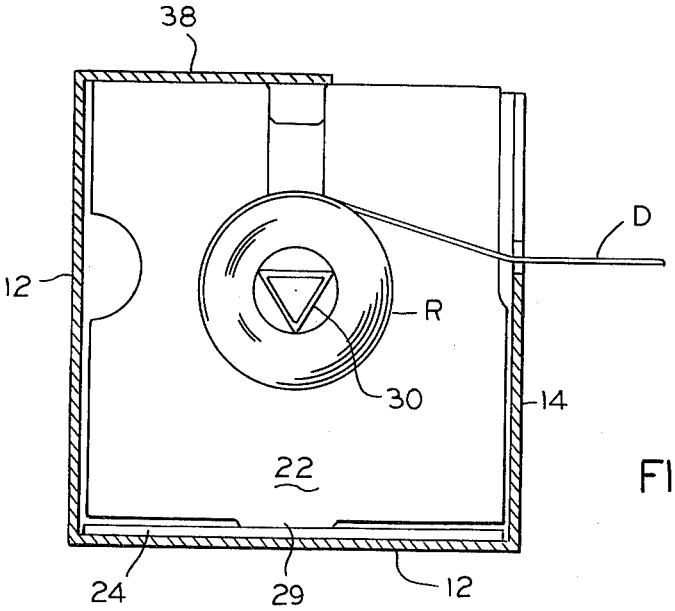
FIG. 7 is a vertical section taken through the container of FIG. 6 along the plane indicated by the arrows 7—7 of FIG. 6, and looking in the direction thereof.

The container according to the present invention is denoted by the reference numeral 10 and is formed from a cut and scored blank of paperboard 10A which when erected is adapted to enclose and dispense disks D from a reel R thereof supported within container 10. It is an important feature of the invention that a support for the reel R is formed from a blank separable from blank 10A and formed into proper shape.

Blank 10A and container 10 formed therefrom comprise a bottom panel 11 having a first end panel 12 connected thereto along a fold line 13 and erected to position. A second end panel 14 is erected to position along a fold line 16.

Opposed side panels 17 are folded with respect to end panel 12 along fold lines 18 to erected position, and first reinforcing panels 19 are folded with respect to end panel 14 along fold lines 21 against the side panels 17 and along the inside thereof.

Second reinforcing panels 22 are folded along closely spaced fold lines 23 from the upper edges of side panels 17 against first reinforcing panels 19.

Side walls 17 have flaps 24 foldable with respect thereto along fold lines 26 and into position overlying bottom panel 11. Flaps 24 have Walker slots 27 cooperating with locking tabs 28 on the second reinforcing panels to hold panels 17, 19 and 22 firmly together.

A blank 30 is separable from one of the flaps 24 and part of the bottom panel 11, and has fold lines 31 therein, blank 30 being separable along nick lines 32 and 33.

The reinforcing panels 19 and 22 are provided with slots 34 terminating at the bottoms thereof in a V-shaped notch 36. The slots 34 are both in register in panels 19 and 22 and are opposed to like slots in the opposed panels 19 and 22. When blank 30 is folded with a triangular cross section it is supported at the ends in the V notches 36.

Figure 8:
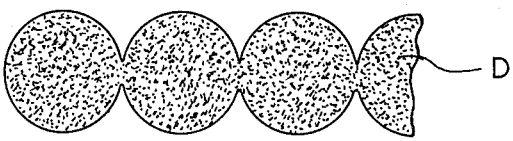
FIG. 8 is a plan view of a product which may be dispensed from the container.

End wall 14 is cut out as seen, and when a reel R of product is supported upon the folded blank 30, disks D of the reel R can be severed from the strip thereof seen in FIG. 8 on end panel 14.

A cover panel 38 is foldably connected to end panel 12 along a fold line 39 and has a flap 41 connected thereto along fold line 42, flap 41 being adapted to be folded behind wall 14. Cover panel 38 has a tear flap 46 separable from cover panel 38 along a tear line 43, so that the contents of container 10 may be viewed.

Locking tabs 44 foldable with respect to cover panel 38 are entrant to the slots 34 to close container 10.

A hand hole 47 is provided in end wall 12 for carrying container 10 to its place of use.

We claim:

1. A shipping container for a product supported upon a core in turn supported on the walls of said container, said container being formed from a cut and scored blank of paperboard or the like and comprising:

(a) a bottom panel having opposed end panels foldable with respect thereto to erected position;

(b) opposed side panels foldable with respect to one of said end panels to erected position to define opposed outer side panels, said opposed side panels having flaps foldable with respect thereto along bottom edges and into position over said bottom panel;

(c) opposed first inner reinforcing panels foldable with respect to the sides of the other of said end panels and erectable into position against the insides of said opposed side panels;

(d) second inner reinforcing panels foldable with respect to said opposed side panels along the upper edges thereof and into position against said first reinforcing panels;

(e) said first and second reinforcing panels being provided with slots in register and in facing relationship with the slots of an opposite pair of reinforcing panels to receive the ends of a core having product wound thereon; and (f) said bottom panel and one of said flaps being cut and scored to provide a removable blank for holding into position to define a core for support of said product.

2. A container according to claim 1, wherein said other of said end panels is provided with a cutout portion providing an edge for severing said wound product as desired.

3. A container according to claim 1, wherein said one of said end panels is provided with a cover panel.

4. A container according to claim 3, wherein said cover panel has a flap foldable into position behind the other of said end panels.

5. A container according to claim 3, wherein said cover panel is provided with locking tabs receivable within said slots.

6. An interlocking shipping container, formed of a unitary blank of foldable paperboard, for transporting and dispensing a product carried on a core which is supported on the walls of the container, said container comprising:

(a) a bottom wall panel;

(b) pairs of opposed side and end wall panels upstanding from the bottom wall panel to form therewith a boxlike structure open at the top;

(c) a first pair of opposed reinforcing panels foldably joined to upper edges of respective side wall panels;

(d) a second pair of reinforcing panels foldably joined to opposite sides of one of said end wall panels;

(e) corresponding reinforcing panels of said pairs being folded in face-to-face relationship with each other and against the inner surfaces of related side wall panels;

(f) said reinforcing panels having aligned slots for supporting ends of a product holding core;

(g) a cover panel foldably joined to one of said end wall panels;

(h) certain of said panels including lock tabs for engagement with recesses in other panels to secure the panels of the container together in interlocked relation, without requiring external securing means; and (i) said core being formed from material cut from certain panels of said blank and detachably secured thereto prior to assembly of said container.

7. A container according to claim 6, wherein said cover panel includes a detachable section which may be removed for viewing contents of the container.

8. A container according to claim 6, wherein one of said end walls has a recessed upper edge for severing lengths of product as it is dispensed from said container.

* * * * *